US011368805B2

(12) United States Patent
Yeh et al.

(10) Patent No.: US 11,368,805 B2
(45) Date of Patent: Jun. 21, 2022

(54) TEST CIRCUIT, TEST METHOD AND AUDIO CODEC FOR STEREO MICROPHONES

(71) Applicant: REALTEK SEMICONDUCTOR CORPORATION, Hsinchu (TW)

(72) Inventors: Tsung-Li Yeh, Hsinchu (TW); Yi-Cheng Huang, Chiayi County (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 0 days.

(21) Appl. No.: 17/090,929

(22) Filed: Nov. 6, 2020

(65) Prior Publication Data

US 2021/0144501 A1 May 13, 2021

(30) Foreign Application Priority Data

Nov. 11, 2019 (TW) ..... 108140873

(51) Int. Cl.

| | |
|---|---|
| ***H04R 29/00*** | (2006.01) |
| ***H04R 5/027*** | (2006.01) |
| ***H04R 3/00*** | (2006.01) |
| ***G10L 19/00*** | (2013.01) |
| ***H04R 1/40*** | (2006.01) |
| ***G10L 25/51*** | (2013.01) |

(52) U.S. Cl.

CPC ..... *H04R 29/006* (2013.01); *G10L 19/00* (2013.01); *G10L 25/51* (2013.01); *H04R 1/406* (2013.01); *H04R 3/005* (2013.01); *H04R 5/027* (2013.01)

(58) Field of Classification Search

CPC ..... H04R 3/005; H04R 1/406; H04R 29/006; H04R 5/027; G10L 19/00; G10L 25/51

USPC ..... 381/58

See application file for complete search history.

(56) References Cited

U.S. PATENT DOCUMENTS

2019/0079573 A1* 3/2019 Hanson ..... G06F 1/3203

FOREIGN PATENT DOCUMENTS

| | | | |
|---|---|---|---|
| CN | 109068238 | A | 12/2018 |
| TW | 594025 | B | 6/2004 |

OTHER PUBLICATIONS

OA letter of the counterpart TW application (appl. No. 108140873) dated Oct. 15, 2020. Summary of the OA letter: Claims 1-9 are rejected under Taiwan Patent Law Article 22(2) as being unpatentable over reference 1 (US 2019/0079573 A1).

OA letter of the counterpart CN application (appl. No. 201911129915.1) dated Dec. 1, 2021. Summary of the OA letter: Claims 1-9 are unpatentable over CN109068238 and TW594025B.

* cited by examiner

*Primary Examiner* — Paul Kim
(74) *Attorney, Agent, or Firm* — WPAT, PC

(57) ABSTRACT

The invention discloses a test circuit, a test method and an audio codec for testing a microphone module that includes a first microphone and a second microphone. The first microphone outputs the first data, and the second microphone outputs the second data. The test circuit includes a comparison circuit, a counter, and a decision circuit. The comparison circuit is configured to compare the first data with the second data and generate a comparison result. The counter is coupled to the comparison circuit and configured to generate a count value based on the comparison result. The decision circuit is coupled to the counter and configured to indicate, based on the count value and a threshold value, whether the microphone module has an error.

11 Claims, 8 Drawing Sheets

200

700

TEST CIRCUIT, TEST METHOD AND AUDIO CODEC FOR STEREO MICROPHONES

BACKGROUND OF THE INVENTION

1. Field of the Invention

The present invention generally relates to a stereo (two-channel) microphone, and, more particularly, to a test circuit, test method and audio codec for the stereo microphone.

2. Description of Related Art

FIG. 1 is a functional block diagram of a conventional stereo microphone system. The stereo microphone system 100 includes a stereo microphone 110 and an audio codec 120. The stereo microphone 110, which is soldered on a printed circuit board (PCB), includes a microphone 112 and a microphone 114. The microphones 112 and 114 may be microphones fabricated using the microelectromechanical system (MEMS) technology. The microphone 112 has a clock pin cp1, a data output pin dp1 and a selection pin SLC1. The microphone 114 has a clock pin cp2, a data output pin dp2 and a selection pin SLC2. The clock pin cp1 and the clock pin cp2 are electrically connected on the PCB and simultaneously receive the clock CLK provided by the audio codec 120. The microphone 112 and the microphone 114 operate according to the clock CLK. The data output pin dp1 and the data output pin dp2 are electrically connected on the PCB. The microphone 112 outputs the one-bit pulse density modulation (PDM) data d1 through the data output pin dp1, and the microphone 114 outputs the one-bit PDM data d2 through the data output pin dp2. Data D is a combination of the data d1 and the data d2. The audio codec 120 provides the clock CLK for the stereo microphone 110 through a clock pin and receives the data D (which includes the data d1 and the data d2) generated by the stereo microphone 110 through a data pin. After receiving multiple sets of data d1 and multiple sets of data d2, the audio codec 120 decodes or filters the data d1 and the data d2 to generate a multi-bit pulse-code modulation (PCM) data D_PCM.

FIG. 2 shows the data d1, the data d2, the data D and the clock CLK. A the selection pin SLC1 is connected to the voltage source VDD and the selection pin SLC2 is grounded, when the clock CLK is at a high level (i.e., logic 1), the output data d1 of the microphone 112 has a value (i.e., the bit value "value1" in FIG. 2 which can be binary "1" or binary "0"), whereas the output data d2 of the microphone 114 is high impedance (i.e., "Z" in FIG. 2); when the clock CLK is at a low level (i.e., logic 0), the output data d1 of the microphone 112 is high impedance ("Z"), whereas the output data d2 of the microphone 114 has a value (i.e., the bit value "value2" in FIG. 2 which can be binary "1" or binary "0"). When the stereo microphone 110 is working as normal, the content of the data D is the alternate arrangement of the bit values value1 and the bit values value2, which is equivalent to the alternate arrangement of the data d1 and the data d2.

Unfortunately, it is possible that the microphone 112 and the microphone 114 are not firmly soldered on the PCB. More specifically, the clock pin cp1, the data output pin dp1, the clock pin cp2 and the data output pin dp2 may be floating, resulting in an error in the stereo microphone 110 due to the failure in the physical connection required for information or communication path between the audio codec 120 and the microphone 112 and/or the microphone 114.

However, spotting the pin that is floating due to soldering with human eyes can be a difficult task, and thus debugging the circuit becomes an issue.

SUMMARY OF THE INVENTION

In view of the issues of the prior art, an object of the present invention is to provide a test circuit, test methods and an audio codec for a stereo microphone, so as to make an improvement to the prior art.

A circuit for testing a microphone module (e.g., a stereo microphone) is provided. The microphone module operates according to a clock and includes a first microphone and a second microphone. The first microphone outputs a first data through a first data output pin when the clock is at a first level, and the second microphone outputs a second data through a second data output pin when the clock is at a second level. The first level is different from the second level. The first data output pin and the second data output pin are coupled to a capacitor. The circuit includes a comparison circuit, a counter and a decision circuit. The comparison circuit is configured to compare the first data and the second data and to generate a comparison result. The counter is coupled to the comparison circuit and configured to generate a count value based on the comparison result. The decision circuit is coupled to the counter and configured to determine whether there is an error in the microphone module based on the count value and a threshold value.

A method of testing a microphone module (e.g., a stereo microphone) is provided. The microphone module operates according to a clock and includes a first microphone and a second microphone. The first microphone outputs a first data through a first data output pin when the clock is at a first level, and the second microphone outputs a second data through a second data output pin when the clock is at a second level. The first level is different from the second level. The first data output pin and the second data output pin are coupled to a capacitor. The method includes the following steps: (a) comparing the first data with the second data and generating a comparison result; (b) generating a count value based on the comparison result; and (c) determining whether there is an error in the microphone module based on the count value and a threshold value.

A method of testing a microphone module (e.g., a stereo microphone) is provided. The microphone module operates according to a clock and includes a first microphone and a second microphone. The first microphone outputs a plurality of first data through a first data output pin when the clock is at a first level, and the second microphone outputs a plurality of second data through a second data output pin when the clock is at a second level. The first level is different from the second level. The first data output pin and the second data output pin are coupled to a capacitor. The method includes the following steps: (a) decoding or filtering the first data and the second data to generate a first pulse-code modulation (PCM) data and a second PCM data; (b) comparing the first PCM data with the second PCM data and generating a comparison result; (c) generating a count value based on the comparison result; and (d) determining whether there is an error in the microphone module based on the count value and a threshold value.

An audio codec for testing a microphone module (e.g., a stereo microphone) is provided. The microphone module operates according to a clock and includes a first microphone and a second microphone. The first microphone outputs a plurality of first data through a first data output pin when the clock is at a first level, and the second microphone outputs a plurality of second data through a second data output pin when the clock is at a second level. The first level is different from the second level. The first data output pin and the second data output pin are coupled to a capacitor. The audio codec includes a memory and a processor. The memory is configured to store a plurality of program instructions or program codes. The processor is coupled to the memory and configured to execute the program instructions or program codes to perform the following steps: (a) decoding or filtering the first data and the second data to generate a first pulse-code modulation (PCM) data and a second PCM data; (b) comparing the first PCM data with the second PCM data and generating a comparison result; (c) generating a count value based on the comparison result; and (d) determining whether there is an error in the microphone module based on the count value and a threshold value.

According to the present invention, the test circuit, test methods and audio codec for the stereo microphone can quickly find out whether there is an error in the stereo microphone. In comparison with the conventional technology, the present invention makes circuit debugging faster and thus saves time.

These and other objectives of the present invention no doubt become obvious to those of ordinary skill in the art after reading the following detailed description of the preferred embodiments with reference to the various figures and drawings.

DETAILED DESCRIPTION OF THE EMBODIMENTS

The following description is written by referring to terms of this technical field. If any term is defined in this specification, such term should be interpreted accordingly. In addition, the connection between objects or events in the below-described embodiments can be direct or indirect provided that these embodiments are practicable under such connection. Said "indirect" means that an intermediate object or a physical space exists between the objects, or an intermediate event or a time interval exists between the events.

The disclosure herein includes test circuits, test methods and an audio codec for stereo microphones. On account of that some or all elements of the test circuits and the audio codec could be known, the detail of such elements is omitted provided that such detail has little to do with the features of this disclosure, and that this omission nowhere dissatisfies the specification and enablement requirements. Some or all of the processes of the test methods may be implemented by software and/or firmware and can be performed by the test circuits, the audio codec or their equivalents. A person having ordinary skill in the art can choose components or steps equivalent to those described in this specification to carry out the present invention, which means that the scope of this invention is not limited to the embodiments in the specification.

In this document, the term "coupled" and the term "connected" may mean "directly coupled" and "directly connected" respectively, or "indirectly coupled" and "indirectly connected" respectively. "Coupled" and "connected" may also be used to indicate that two or more elements cooperate or interact with each other.

Although the terms "first," "second," etc., may be used herein to describe various elements, these elements should not be limited by these terms. Rather, these terms are only used to distinguish one element from another. For example, a first element could be termed a second element, and, similarly, a second element could be termed a first element, without departing from the scope of the embodiments.

Figure 1:
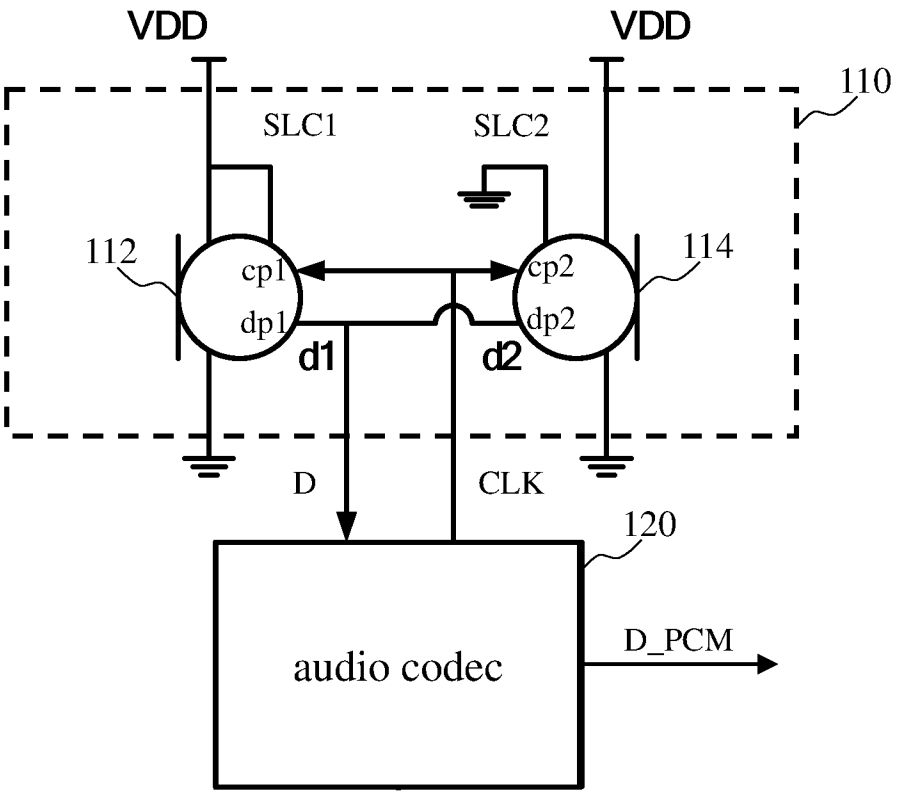
FIG. 1 (prior art)
FIG. 1 illustrates a functional block diagram of a conventional stereo microphone system.
Figure 2:
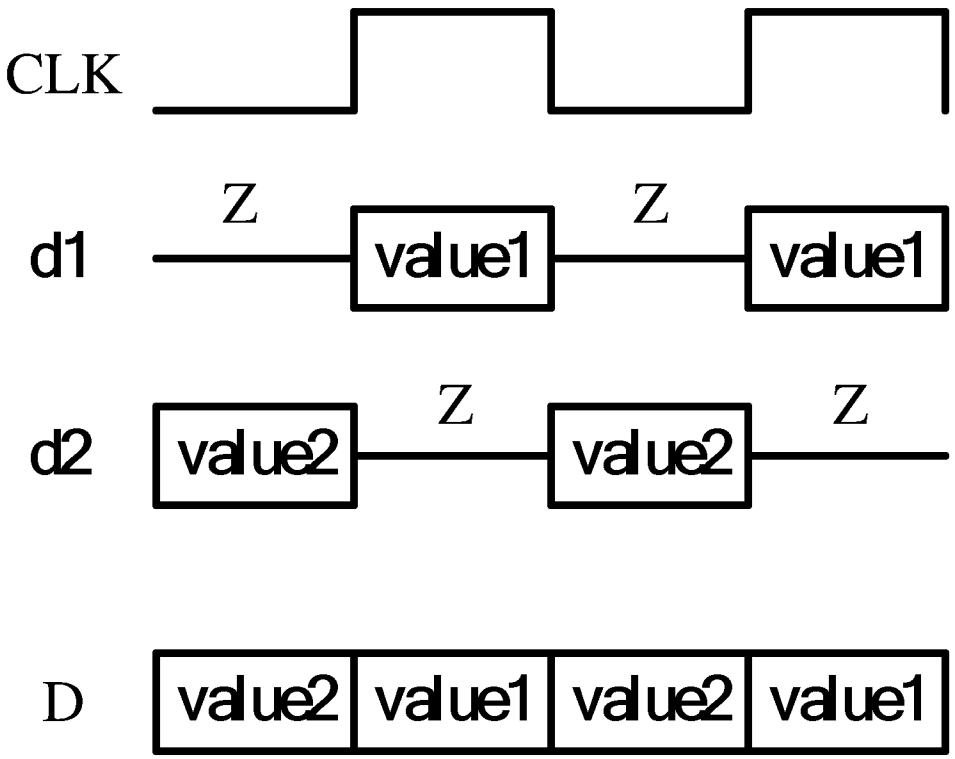
FIG. 2 (prior art)
FIG. 2 illustrates a timing diagram of the data d1, data d2, data D and clock CLK.
Figure 3:
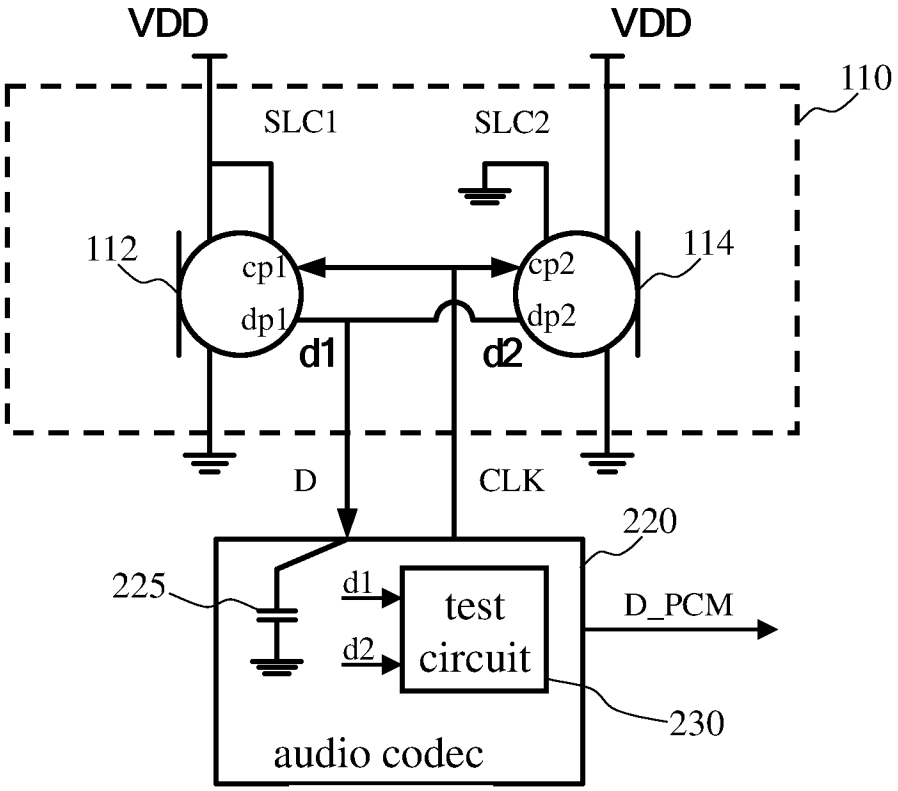
FIG. 3 illustrates a functional block diagram of the stereo microphone system according to the present invention.

FIG. 3 is a functional block diagram of the stereo microphone system according to the present invention. The stereo microphone system 200 includes a stereo microphone 110 and an audio codec 220. The audio codec 220 may be a system on chip (SoC). The stereo microphone 110 and the audio codec 220 are soldered on a PCB (not shown). The audio codec 220 samples the data D with the capacitor 225 provided therein. One end of the capacitor 225 is grounded, and the other end of the capacitor 225 is coupled to one of the pins of the audio codec 220; through that pin, the audio codec 220 receives the data D. The audio codec 220 can retrieve the data d1 and the data d2 from the data D according to the clock CLK and the terminal voltage of the capacitor 225. The audio codec 220 decodes or filters the data d1 and the data d2 to generate multiple multi-bit PCM data D_PCM.

When the microphone 112 and/or the microphone 114 are not firmly soldered on the PCB, the data D has specific contents. For example, when the clock pin cp1 or the data output pin dp1 is floating, the data d1 is in the high impedance state; therefore, the terminal voltage of the capacitor 225 does not change (i.e., the previous state of the terminal voltage is maintained) at the high levels of the clock CLK. As a result, the content of the data D includes only the data d2, and therefore, a same sampled result (i.e., the data d2) is obtained by the audio codec 220 during both the high levels and the low levels of the clock CLK. In other words, when the stereo microphone 110 is not firmly soldered on the PCB, two identical data are sampled by the audio codec 220 within one cycle of the clock CLK.

Figure 4:
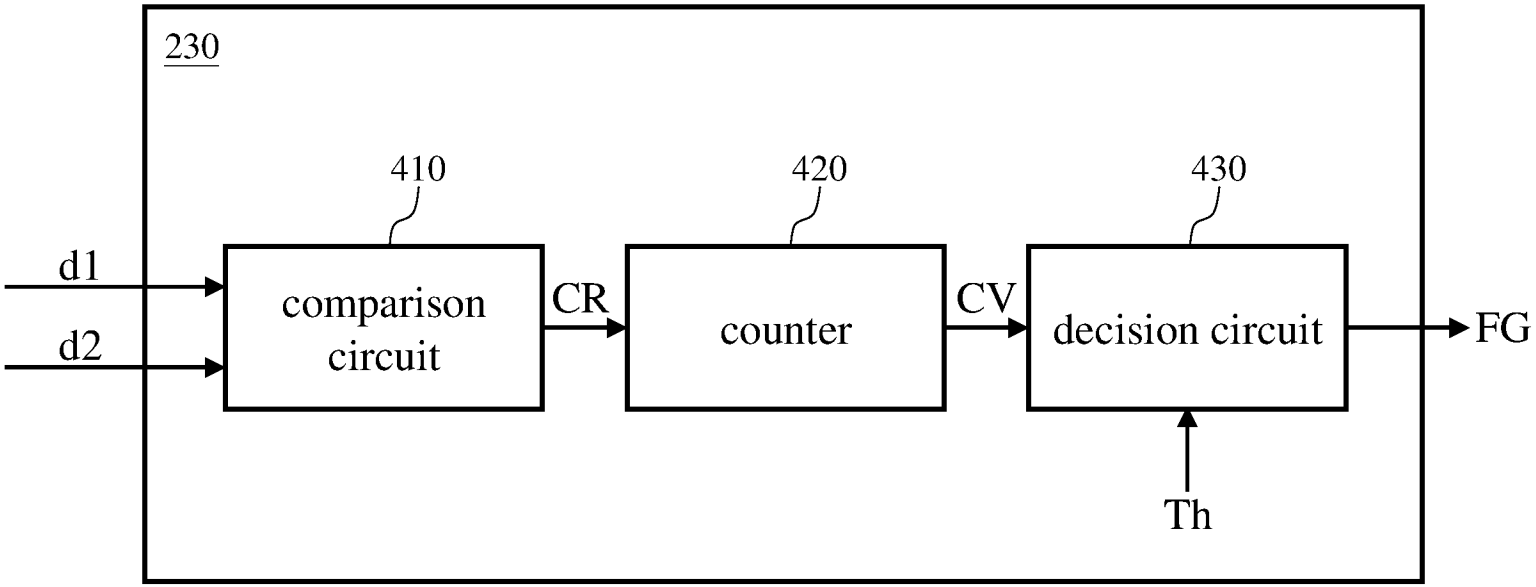
FIG. 4 illustrates a functional block diagram of a test circuit according to an embodiment of the present invention.
Figure 5:
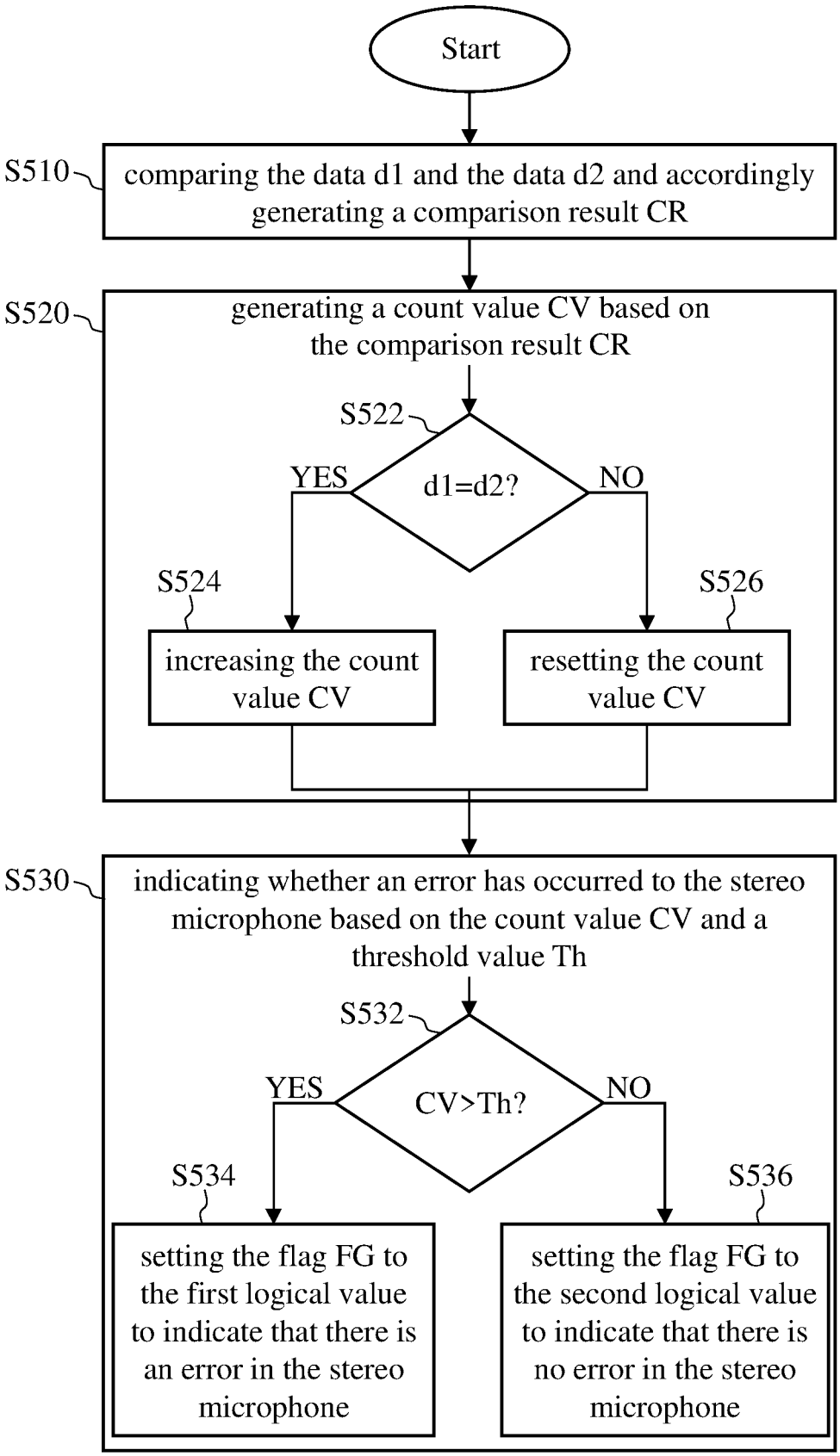
FIG. 5 illustrates a flowchart of the test method according to an embodiment of the present invention.

In one embodiment, the audio codec 220 uses a built-in test circuit 230 to test the stereo microphone 110. FIG. 4 is a functional block diagram of the test circuit according to an embodiment of the present invention. FIG. 5 is a flowchart of the test method according to an embodiment of the present invention. Reference is made to both FIG. 4 and FIG. 5 for the discussions below. The test circuit 230 includes a comparison circuit 410, a counter 420 and a decision circuit 430. The comparison circuit 410 compares the data d1 and the data d2 and accordingly generates a comparison result CR (step S510). The counter 420 generates a count value CV based on the comparison result CR (step S520). Based on the count value CV and the threshold value Th, the decision circuit 430 generates a flag FG to indicate whether an error has occurred to the stereo microphone 110 (step S530). The details of each element and step are discussed below.

Figure 6:
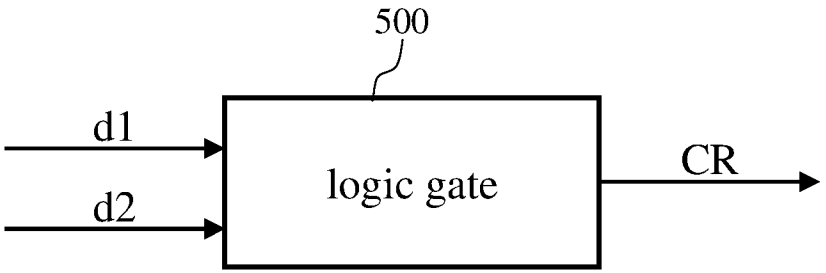
FIG. 6 illustrates an embodiment of the comparison circuit of FIG. 4.

The comparison circuit 410 and step S510 can be implemented with a logic gate. As shown in FIG. 6, the logic gate 500 includes two input terminals and one output terminal. The two input terminals of the logic gate 500 respectively receive the data d1 and the data d2, and the output terminal outputs the comparison result CR. In embodiment (A), the logic gate 500 outputs a logic 1 when the data d1 is the same as the data d2, and the logic gate 500 outputs a logic 0 when the data d1 is different from the data d2. For example, the logic gate 500 may be an exclusive NOR gate (XNOR gate). In embodiment (B), the logic gate 500 outputs a logic 1 when the data d1 is different from the data d2, and the logic gate 500 outputs a logic 0 when the data d1 is the same as the data d2. For example, the logic gate 500 may be an exclusion OR gate (XOR gate).

Step S520 includes sub-steps S522, S524 and S526. In embodiment (A), the counter 420 increases the count value CV (step S524) when the comparison result CR is logic 1 (YES branch of step S522), and the counter 420 resets the count value CV (i.e., zeroing the count value CV) (step S526) when the comparison result CR is logic 0 (NO branch of step S522). In embodiment (B), the counter 420 resets the count value CV (step S526) when the comparison result CR is logic 1 (NO branch of step S522), and the counter 420 increases the count value CV (step S524) when the comparison result CR is logic 0 (YES branch of step S522).

Step S530 includes sub-steps S532, S534 and S536. In sub-step S532, the decision circuit 430 compares the count value CV with the threshold value Th. In both embodiment (A) and embodiment (B), when the count value CV is greater than the threshold value Th (YES branch of step S532), the decision circuit 430 sets the flag FG to the first logical value (e.g., logic 1) to indicate that there is an error in the stereo microphone (step S534). When the count value CV is not greater than the threshold value Th (NO branch of step S532), the decision circuit 430 sets the flag FG to a second logical value (e.g., logic 0) to indicate that there is no error in the stereo microphone (step S536). The first logical value is different from the second logical value. In some embodiments, the decision circuit 430 may be implemented with a comparator. The threshold value Th can be set based on experiences, for example, hundreds or thousands.

In summary, the test circuit 230 and the corresponding test method can find out whether the stereo microphone 110 is abnormal, which helps the circuit designers be aware of the errors in an early stage. The abnormality of the stereo microphone 110 may include, but not limited to, the data output pins and/or clock pins of the microphone 112 and/or the microphone 114 being floating.

Figure 7:
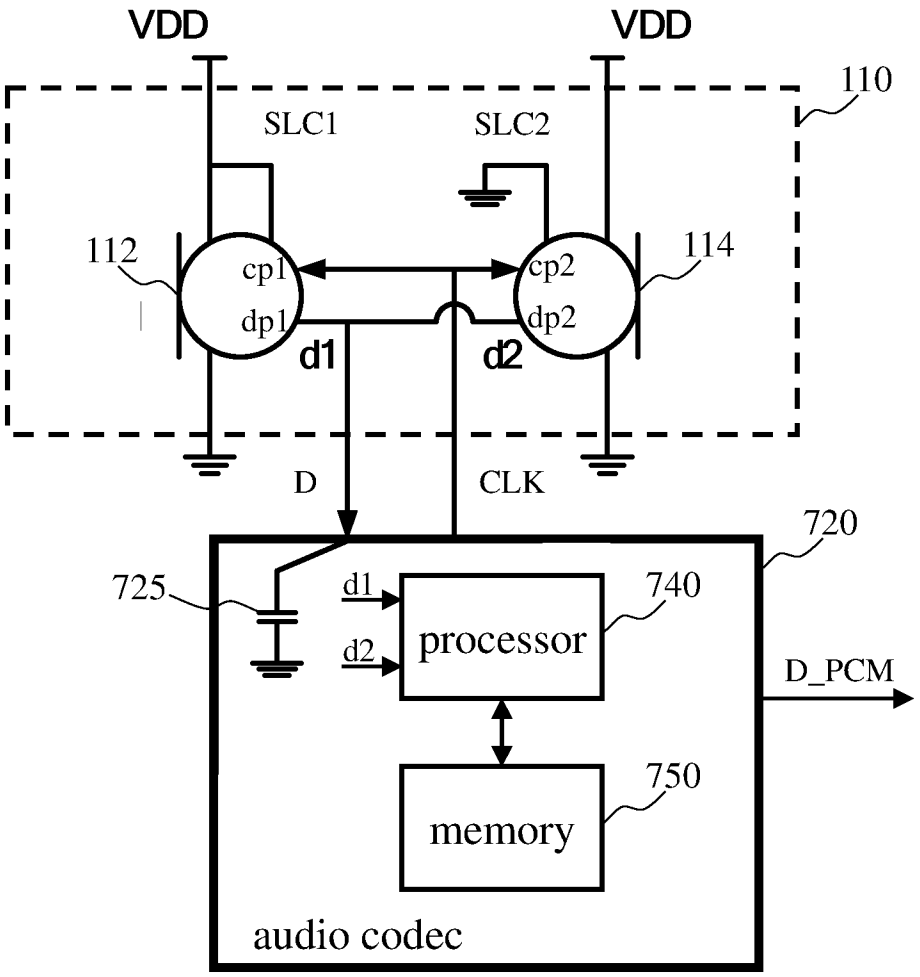
FIG. 7 illustrates a functional block diagram of the stereo microphone system according to another embodiment of the present invention.

Reference is made to FIG. 7, which is a functional block diagram of the stereo microphone system according to another embodiment of the present invention. The stereo microphone system 700 includes the stereo microphone 110 and an audio codec 720. The audio codec 720 includes a capacitor 725, a processor 740 and a memory 750. The audio codec 720 can be an SoC. The stereo microphone 110 and the audio codec 720 are soldered on a PCB (not shown). The audio codec 720 samples the data D through the capacitor 725. One end of the capacitor 725 is grounded, and the other end of the capacitor 725 is coupled to one of the pins of the audio codec 720; through that pin, the audio codec 720 receives the data D. The audio codec 720 can retrieve the data d1 and the data d2 from the data D according to the clock CLK and the terminal voltage of the capacitor 725. The audio codec 720 decodes or filters the data d1 and the data d2 to generate multiple multi-bit PCM data D_PCM.

The processor 740 may be a circuit or an electronic component with program execution capability, such as a central processing unit (CPU), a microprocessor, a microprocessing unit or an application-specific integrated circuit (ASIC). The processor 740 executes multiple program codes or program instructions stored in the memory 750 to process the data d1 and the data d2. In some embodiments, the ASIC can be a digital signal processor (DSP). In the embodiment of FIG. 7, the stereo microphone 110 is tested by the processor 740 executing software and/or firmware (i.e., executing the program codes or program instructions stored in the memory 750).

Figure 8:
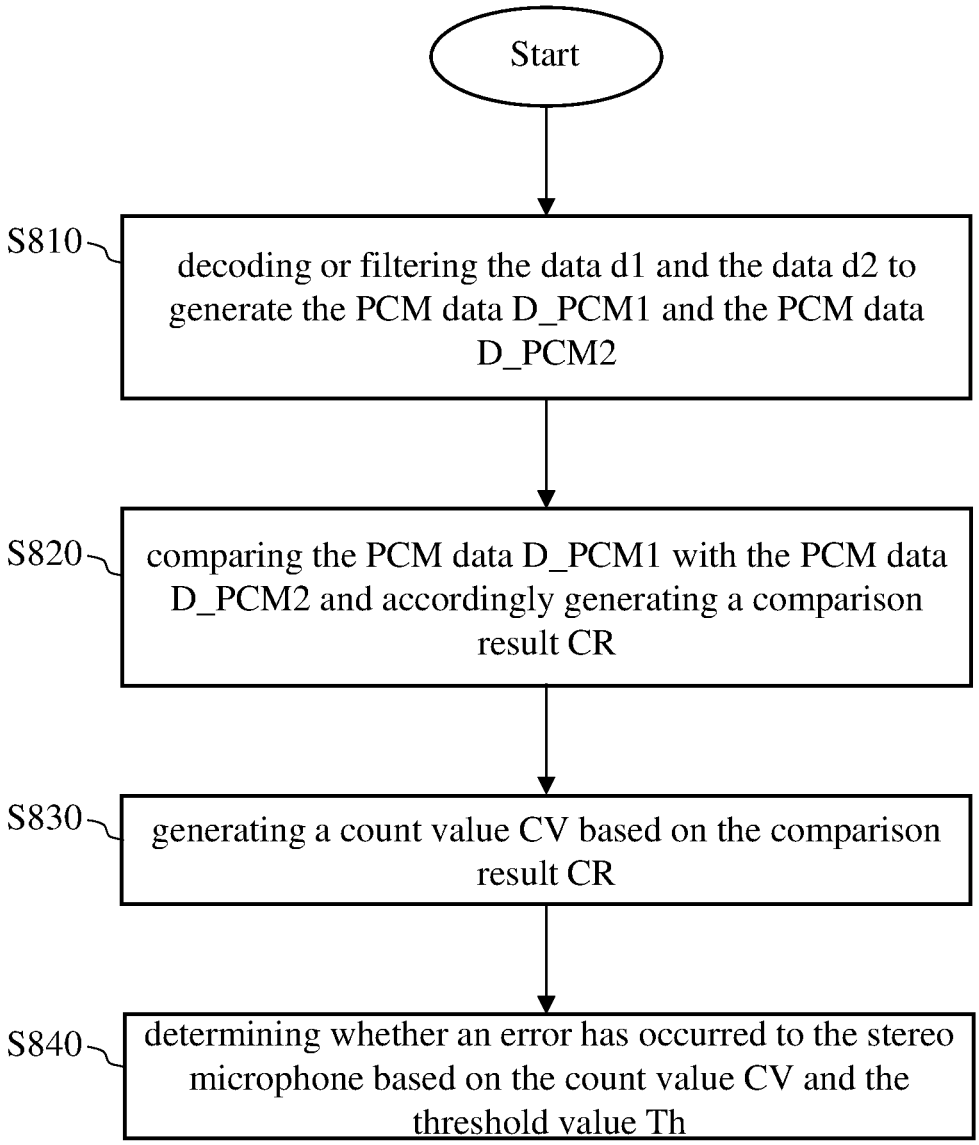
FIG. 8 illustrates a flowchart of the test method according to another embodiment of the present invention.

FIG. 8 is a flowchart of the test method according to another embodiment of the present invention. The method of FIG. 8 is executed by the audio codec 720 and the processor 740.

Initially, the processor 740 decodes or filters multiple data d1 and multiple data d2 to generate the PCM data D_PCM1 and the PCM data D_PCM2 (step S810). The audio codec 720 outputs the PCM data D_PCM1 and the PCM data D_PCM2 simultaneously or alternately. In other words, the PCM data D_PCM contains the PCM data D_PCM1 and the PCM data D_PCM2. The PCM data D_PCM1 corresponds to one channel of the stereo microphone 110, and the PCM data D_PCM2 corresponds to the other channel of the stereo microphone 110. When the data output pin(s) and/or the clock pin(s) of the microphone 112 and/or the microphone 114 are/is floating, the PCM data D_PCM1 is the same as the PCM data D_PCM2. Step S810 is well-known to people having ordinary skill in the art, and the details are thus omitted for brevity.

Next, the processor 740 compares the PCM data D_PCM1 with the PCM data D_PCM2 and accordingly generates a comparison result CR (step S820), generates a count value CV based on the comparison result CR (step S830), and then determines whether an error has occurred to the stereo microphone 110 based on the count value CV and the threshold value Th (step S840). Steps S820, S830 and S840 are similar to steps S510, S520 and S530, respectively, and the details are thus omitted for brevity.

Since a person having ordinary skill in the art can appreciate the implementation detail and the modification thereto of the present method invention through the disclosure of the device invention, repeated and redundant description is thus omitted. Please note that there is no step sequence limitation for the method inventions as long as the execution of each step is applicable. Furthermore, the shape, size, and ratio of any element and the step sequence of any flow chart in the disclosed figures are exemplary for understanding, not for limiting the scope of this invention.

The aforementioned descriptions represent merely the preferred embodiments of the present invention, without any intention to limit the scope of the present invention thereto. Various equivalent changes, alterations, or modifications based on the claims of the present invention are all consequently viewed as being embraced by the scope of the present invention.

What is claimed is:

1. A circuit for testing a microphone module that operates according to a clock and that includes a first microphone and a second microphone, the first microphone outputting a first data through a first data output pin when the clock is at a first level, the second microphone outputting a second data through a second data output pin when the clock is at a second level, the first level being different from the second level, and the first data output pin and the second data output pin being coupled to a capacitor, the circuit comprising:

a comparison circuit configured to compare the first data and the second data and generate a comparison result;

a counter coupled to the comparison circuit and configured to generate a count value based on the comparison result; and a decision circuit coupled to the counter and configured to determine based on the count value and a threshold value whether there is an error in the microphone module.

2. The circuit of claim 1, wherein the first data and the second data are one-bit data, the comparison circuit is a logic gate, a first input terminal of the logic gate receives the first data, a second input terminal of the logic gate receives the second data, and an output terminal of the logic gate outputs the comparison result.

3. The circuit of claim 1, wherein when the comparison result indicates that the first data is the same as the second data, the counter increases the count value; when the comparison result indicates that the first data is different from the second data, the counter resets the count value; and when the count value is greater than the threshold value, the decision circuit determines that there is the error in the microphone module.

4. The circuit of claim 1, wherein the microphone module is a stereo microphone.

5. The circuit of claim 1, wherein the error is a result of a floating pin of the microphone module.

6. A method of testing a microphone module that operates according to a clock and that includes a first microphone and a second microphone, the first microphone outputting a first data through a first data output pin when the clock is at a first level, the second microphone outputting a second data through a second data output pin when the clock is at a second level, the first level being different from the second level, and the first data output pin and the second data output pin being coupled to a capacitor, the method comprising steps of:

(a) comparing the first data with the second data and generating a comparison result;

(b) generating a count value based on the comparison result; and (c) determining whether there is an error in the microphone module based on the count value and a threshold value.

7. The method of claim 6, wherein when the comparison result indicates that the first data is the same as the second data, the count value is increased in the step (b); when the comparison result indicates that the first data is different from the second data, the count value is reset in the step (b); and when the count value is greater than the threshold value, it is determined in the step (c) that there is the error in the microphone module.

8. The method of claim 6, wherein the microphone module is a stereo microphone.

9. The method of claim 6, wherein the error is a result of a floating pin of the microphone module.

10. The method of claim 6, further comprising:

(d) decoding or filtering the first data and the second data to generate a first pulse-code modulation (PCM) data and a second PCM data before the step (a);

wherein the comparison result is generated by comparing the first PCM data and the second PCM data in the step (a).

11. The method of claim 10, wherein when the comparison result indicates that the first PCM data is the same as the second PCM data, the count value is increased in the step (c); when the comparison result indicates that the first PCM data is different from the second PCM data, the count value is reset in the step (c); and when the count value is greater than the threshold value, it is determined in the step (d) that there is the error in the microphone module.

* * * * *